US007322806B2

(12) United States Patent
Sun et al.

(10) Patent No.: US 7,322,806 B2
(45) Date of Patent: Jan. 29, 2008

(54) SCROLL COMPRESSOR WITH EXTERNALLY INSTALLED THERMOSTAT

(75) Inventors: Zili Sun, Arkadelphia, AR (US); Thomas R. Barito, Arkadelphia, AR (US)

(73) Assignee: Scroll Technologies, Arkadelphia, AR (US)

( * ) Notice: Subject to any disclaimer, the term of this patent is extended or adjusted under 35 U.S.C. 154(b) by 58 days.

(21) Appl. No.: 11/325,049

(22) Filed: Jan. 4, 2006

(65) Prior Publication Data

US 2007/0154337 A1 Jul. 5, 2007

(51) Int. Cl.
*F04C 28/28* (2006.01)
*F01C 21/00* (2006.01)
*F01C 1/02* (2006.01)

(52) U.S. Cl. ..... 418/2; 418/55.1; 417/32

(58) Field of Classification Search ..... 418/2, 418/55.1; 417/32
See application file for complete search history.

(56) References Cited

U.S. PATENT DOCUMENTS 4,236,092 A 11/1980 DiFlora
4,503,347 A 3/1985 Bergman
4,685,489 A 8/1987 Yun
4,926,081 A 5/1990 DiFlora
5,076,067 A 12/1991 Prenger
5,141,407 A 8/1992 Ramsey
5,156,539 A 10/1992 Anderson
5,176,506 A 1/1993 Siebel
5,368,446 A 11/1994 Rode
RE35,216 E 4/1996 Anderson
5,509,786 A * 4/1996 Mizutani et al. ..... 417/32
5,511,952 A * 4/1996 Sato ..... 417/63
5,527,158 A 6/1996 Ramsey
5,545,019 A 8/1996 Beck
5,580,229 A 12/1996 Beck
5,591,014 A 1/1997 Wallis
5,593,294 A 1/1997 Houghtby
5,607,288 A 3/1997 Wallis
5,640,854 A 6/1997 Fogt
5,707,210 A 1/1998 Ramsey
5,769,659 A 6/1998 Ceylan
5,800,141 A 9/1998 Ceylan
5,803,716 A 9/1998 Wallis
5,921,761 A 7/1999 Eckels
5,931,649 A 8/1999 Caillat
5,975,854 A 11/1999 Culp
6,267,565 B1 7/2001 Seibel
6,364,619 B1 * 4/2002 Williams et al. ..... 417/32
6,398,507 B1 * 6/2002 Choi ..... 417/32
6,406,266 B1 * 6/2002 Hugenroth et al. ..... 417/44.1
6,412,293 B1 7/2002 Pham (Continued)

*Primary Examiner*—Thomas Denion
*Assistant Examiner*—Mary A Davis
(74) *Attorney, Agent, or Firm*—Carlson, Gaskey & Olds

(57) ABSTRACT

A thermostat for sensing an unduly high temperature in a sealed compressor, which is a scroll compressor in the disclosed embodiment, extends through the housing of the sealed compressor into the body of a non-orbiting scroll. Since the thermostat extends through the housing, the wires need not be sealed as they extend from the housing. Still, the thermostat is positioned close to the compression chambers and at a location that will quickly heat when undesirable conditions exist within the sealed compressor. In this manner, the present invention is able to rapidly respond to an undesirable situation to allow a system control to have an indication of the undesired condition.

6 Claims, 1 Drawing Sheet

U.S. PATENT DOCUMENTS 6,454,538 B1 * 9/2002 Witham et al. ..... 417/32
6,540,484 B1 * 4/2003 Hugenroth et al. ..... 417/32
6,615,594 B2 9/2003 Jayanth
6,615,598 B1 9/2003 Wang
6,718,784 B1 * 4/2004 Bushnell ..... 62/244
6,745,584 B2 6/2004 Pham
6,758,050 B2 7/2004 Jayanth
6,758,051 B2 7/2004 Jayanth
2004/0115063 A1 * 6/2004 Hong et al. ..... 417/32

* cited by examiner

SCROLL COMPRESSOR WITH EXTERNALLY INSTALLED THERMOSTAT

BACKGROUND OF THE INVENTION

This application relates to a thermostat for use as a protective device in a scroll compressor, wherein the thermostat extends into a thermal well through an outer housing shell, and into the body of the non-orbiting scroll.

Scroll compressors are becoming widely utilized in refrigerant compression applications. In a scroll compressor, a pair of scroll members each has a base and a generally spiral wrap extending from the base. The wraps interfit to define compression chambers. One of the two scroll members is caused to orbit relative to the other, and as it does orbit, compression chambers defined between the spiral wraps are reduced in size to compress an entrapped refrigerant. An electric motor drives a shaft to in turn drive the orbiting scroll member through a coupling to cause the orbiting scroll member to orbit.

Various challenges arise with regard to the operation of a compressor, and in particular a scroll compressor. One challenge has to do with various operational problems that can raise the internal temperature in the sealed compressor housing.

Typically, a compressor includes a compressor pump unit mounted within a sealed housing the motor, and into compression chambers. Various problems can cause the temperature of the scroll set to reach undesirable levels, which will cause mechanical failures. As examples, if refrigerant has leaked from the refrigerant system such that there is too little refrigerant or if the evaporator fan fails, then the system condition will change and the compressor will see very high pressure ratios between discharge and suction. Compressing refrigerants to very high pressure ratios will generate unduly high temperature at discharge and also in the scroll itself.

For all of these reasons, thermal protection is typically included into a sealed compressor. Known types of thermal protection include a thermal shutoff switch associated with the motor. If the temperature of this switch becomes too high, it opens to stop operation of the compressor motor. Other types include the provision of thermostats in various locations within the sealed compressor housing. These have several downsides, including the fact that positioning the thermostat within the housing makes it difficult to communicate the thermostat to a system control outside of the compressor. Most of this prior art type thermostat connection communicates directly to the thermal protection switch at the compressor motor.

One proposed scroll compressor includes a thermostat extending through the wall of the housing and into a discharge chamber. However, the location of this thermostat does not necessarily receive adequate flow of refrigerant, and in particular at low volume flow times, such that it will shut down the system as quickly as would be desirable.

SUMMARY OF THE INVENTION

In a disclosed embodiment of this invention, a thermal well is defined in an outer housing shell of a compressor. In particular, the compressor is a scroll compressor. A thermostat is inserted into this thermal well such that it extends into a portion of a compressor pump unit. The thermostat is provided into a body of a non-orbiting scroll in the disclosed embodiment. The thermostat communicates with the system control for the refrigerant system. The body of the non-orbiting scroll will become quite hot very rapidly when low volume flow operation occurs, and also when several other undesired operation situations may occur. Thus, the thermostat will act as a prompt sensor to send a signal that the temperatures have reached undesirable levels within the scroll compressor. The signal from the sensor may cause a system control to stop operation of the overall refrigerant system. By placing the thermostat within this thermal well, wiring between the thermostat and the system control is made less complicated. As one example, the wires extending from the thermostat to the system control need not extend through the sealed housing.

These and other features of the present invention can be best understood from the following specification and drawings, the following of which is a brief description.

DETAILED DESCRIPTION OF THE PREFERRED EMBODIMENT

Figures 1A, 1B:
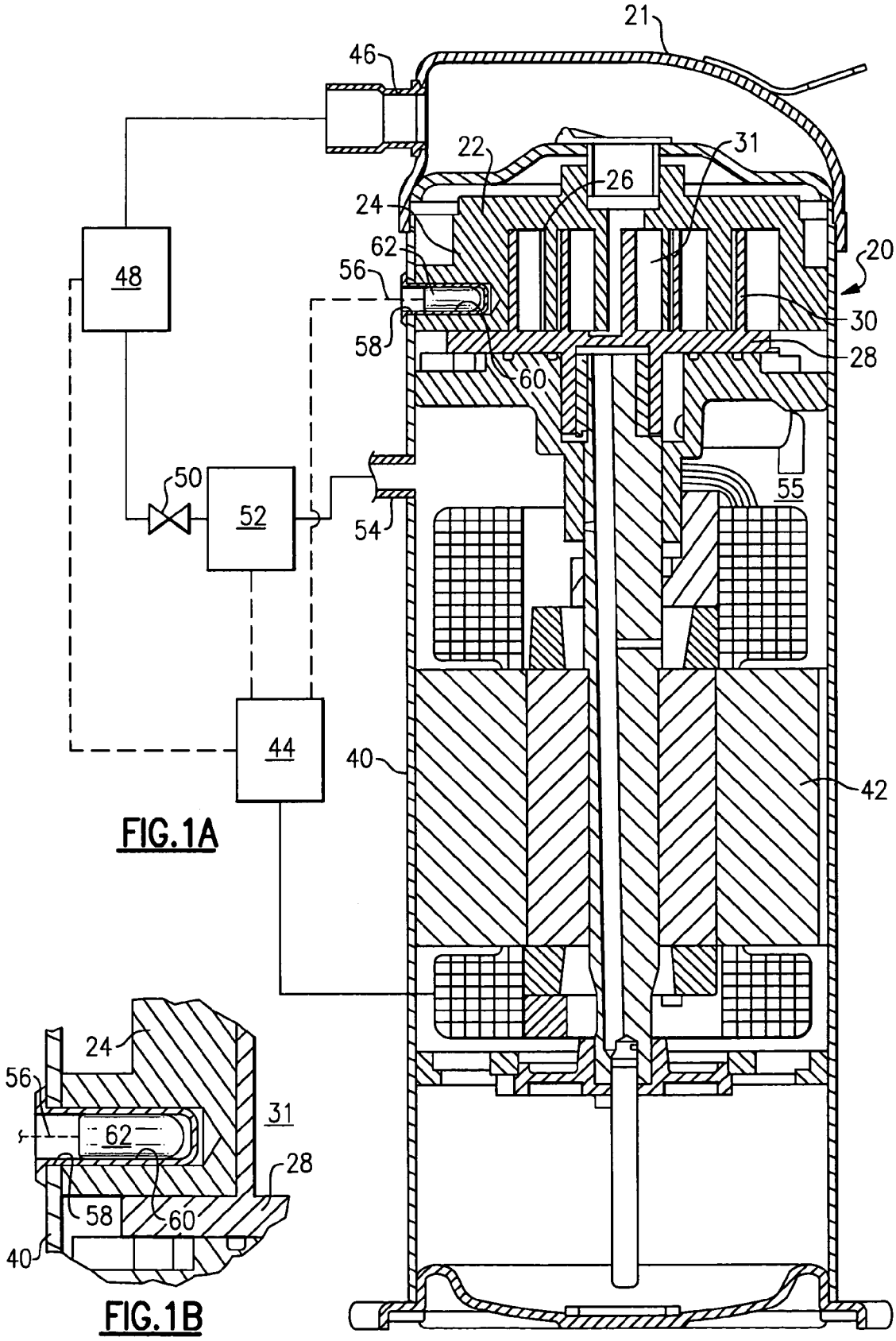
FIG. 1A is a schematic of a refrigerant system incorporating the present invention.
FIG. 1B is an enlarged view of the circled area in FIG. 1A.

As shown in FIG. 1A, a refrigerant system 20 incorporates a sealed compressor 21. Sealed compressor 21 includes a non-orbiting scroll member 22 having an outer housing body 24 and a radially inner general spiral wrap 26. An orbiting scroll member 28 has its wrap 30 interfitting with wrap 26 to define compression chambers 31, as known.

The compressor 21 includes a housing shell 40 sealing the scroll compressor and a motor 42. An outlet 46 receives a compressed refrigerant, and communicates that compressed refrigerant downstream to a condenser 48. Refrigerant from the condenser 48 passes to an expansion device 50, and then to an evaporator 52. Refrigerant returns from the evaporator 52 back through a suction port 54 into a chamber 55 surrounding the motor 42. From chamber 55, the refrigerant passes back to the compression chambers 31.

A control 44 for the refrigerant system 20 is operable to control fans associated with the condenser 48 and evaporator 52, and the motor 42.

As is known, under certain conditions, it would be desirable to stop operation of the refrigerant system 20. These conditions will typically result in unduly high temperatures within the sealed scroll compressor 21. As one example, if there is too little refrigerant passing through the system 20, temperatures within the compressor pump unit including the non-orbiting scroll 22 and the orbiting scroll 28 become unduly high. A thermal well 56 is defined within the body 24 of the non-orbiting scroll 22 to receive a thermostat 62. The thermal well 56 passes through an opening 58 in the housing shell 40. The thermostat is inserted into the thermal well, and contacts an inner surface 60 of the thermal well. The thermostat sits in the body 24 of the non-orbiting scroll 22 spaced only slightly radially outwardly from the compression chambers 31. When a problem occurs within the sealed compressor 21, the thermostat 62 will quickly heat. The thermostat sends a signal to the control 44, and when the control 44 sees that the temperature has reached unduly high temperatures, it will stop operation of the refrigerant system 20, such as shutting down operation of the compressor motor 42, the fans associated with the evaporator and condenser, and any other system components.

It is the provision of the thermostat within the body 24 of the non-orbiting scroll 22 that is inventive. By positioning this thermostat external to the compressor housing, but yet in contact with the compressor pump unit, and spaced closely from the compression chambers, the present invention is able to easily and simply wire the thermostat to the system control 44, while still ensuring the thermostat will be in a location such that it will quickly identify a problem situation.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A scroll compressor comprising:

a non-orbiting scroll member comprising a base and a generally spiral wrap extending into said base, a body of said non-orbiting scroll member being spaced radially outwardly of said wrap;

an orbiting scroll member having a base and a generally spiral wrap extending from its base, said wraps of said orbiting and non-orbiting scroll members interfitting to define compression chambers;

a motor for driving said orbiting scroll member to orbit;

a housing for housing said orbiting scroll member, said non-orbiting scroll member and said motor, said housing being sealed to be fluid-tight; and a thermal well extending through said housing and into said non-orbiting scroll, and receiving a sensor.

2. The scroll compressor as set forth in claim 1, wherein said sensor being a thermostat inserted into said thermal well, said thermostat communicating with a system control such that said system control can stop operation of a refrigerant system associated with said scroll compressor if said thermostat senses an unduly high temperature.

3. The scroll compressor as set forth in claim 2, wherein said system control shuts down said motor when an unduly high temperature is sensed.

4. A refrigerant system comprising:

a compressor, a condenser, an expansion device, and an evaporator, said compressor being a scroll compressor;

said scroll compressor having a non-orbiting scroll member comprising a base and a generally spiral wrap extending into said base, a body of said non-orbiting scroll member being spaced radially outwardly of said wrap, an orbiting scroll member having a base and a generally spiral wrap extending from its base, said wraps of said orbiting and non-orbiting scroll members interfitting to define compression chambers, a motor for driving said orbiting scroll member to orbit, and a housing for housing said orbiting scroll member, said non-orbiting scroll member and said motor, said housing being sealed to be fluid-tight, a thermal well extending through said housing and into said body of said non-orbiting scroll and a sensor in said thermal well; and a control for receiving signals from said sensor and stopping operation of said refrigerant system if said sensor indicates undesirable conditions in said compressor.

5. The refrigerant system as set forth in claim 4, wherein said sensor is a thermostat being inserted into said thermal well, said thermostat communicating with a system control such that said system control can stop operation of a refrigerant system associated with said scroll compressor if said thermostat senses an unduly high temperature.

6. The refrigerant system as set forth in claim 4, wherein said system control shuts down said motor when an unduly high temperature is sensed.

* * * * *